US006485378B1

(12) United States Patent
Boehm

(10) Patent No.: US 6,485,378 B1
(45) Date of Patent: Nov. 26, 2002

(54) GOLF BALL

(75) Inventor: Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/447,653

(22) Filed: Nov. 23, 1999

(51) Int. Cl.[7] ..... A63B 37/06
(52) U.S. Cl. ..... 473/374; 473/371
(58) Field of Search ..... 473/373, 374, 473/376, 614, 370, 371, 377

(56) References Cited

U.S. PATENT DOCUMENTS

| | | | | |
|---|---|---|---|---|
| 697,925 | A | | 4/1902 | Kempshall |
| 698,516 | A | | 4/1902 | Kempshall |
| 700,658 | A | | 5/1902 | Kempshall |
| 701,741 | A | | 6/1902 | Kempshall |
| 704,748 | A | | 7/1902 | Kempshall |
| 704,838 | A | | 7/1902 | Kempshall |
| 711,508 | A | | 10/1902 | Kempshall |
| 720,852 | A | | 2/1903 | Smith, Jr. |
| 726,471 | A | * | 4/1903 | Smith ..... 473/376 |
| 757,600 | A | | 4/1904 | Crawford |
| 780,582 | A | | 1/1905 | Richards |
| 790,252 | A | | 5/1905 | Du Mahaut |
| 1,255,388 | A | | 2/1918 | Cobb |
| 1,426,712 | A | | 8/1922 | Chatfield |
| 1,482,232 | A | | 1/1924 | Hazeltine |
| 1,524,171 | A | | 1/1925 | Chatfield |
| 1,553,386 | A | | 9/1925 | Kuhlke |
| 1,855,448 | A | | 4/1932 | Hazeltine |
| 2,055,326 | A | | 9/1936 | Young |
| 2,181,350 | A | | 11/1939 | Smith |
| 2,307,182 | A | | 1/1943 | Young |
| 2,364,955 | A | | 12/1944 | Diddel |
| 2,376,085 | A | | 5/1945 | Radford et al. |
| 3,228,686 | A | | 1/1966 | Faulkner, III |

(List continued on next page.)

FOREIGN PATENT DOCUMENTS

| | | |
|---|---|---|
| GB | 234713 | 6/1925 |
| GB | 1 321 270 | 6/1973 |
| GB | 2 007 581 A | 5/1979 |
| GB | 2 162 072 A | 1/1986 |
| JP | 9285565 | 11/1997 |

*Primary Examiner*—Mark S. Graham
*Assistant Examiner*—Raeann Gorden
(74) *Attorney, Agent, or Firm*—Swidler Berlin Shereff Friedman, LLP

(57) ABSTRACT

A golf ball comprising an inner core, an outer core, and a cover is disclosed. The outer core surrounds the inner core, and the cover encases the cores. The inner core has a plurality of projections forming gaps between each projection, where the free ends of the projections form a spheroid-shaped surface. The inner core is formed of a first material and the outer core is formed of a second material. The outer core is non-wound, and the second material is disposed within the gaps in the inner core so that the outer surface of the outer core is substantially spherical. The first and second materials have substantially different material properties. In one embodiment, the projections have enlarged free ends. In another embodiment, the projections taper from a base outward. In yet another embodiment, the maximum length of each projection is greater than the maximum width.

38 Claims, 5 Drawing Sheets

U.S. PATENT DOCUMENTS

| | | | | |
|---|---|---|---|---|
| 3,256,019 | A | | 6/1966 | Barton |
| 3,738,655 | A | | 6/1973 | Feddick et al. |
| 4,173,345 | A | | 11/1979 | Pocklington |
| 4,203,941 | A | | 5/1980 | Brooker |
| 4,264,075 | A | | 4/1981 | Miller et al. |
| 4,804,189 | A | | 2/1989 | Gobush ..... 273/232 |
| 4,830,378 | A | | 5/1989 | Aoyama ..... 273/232 |
| 5,020,803 | A | | 6/1991 | Gendreau et al. ..... 273/225 |
| D348,915 | S | | 7/1994 | Fraser |
| 5,421,580 | A | | 6/1995 | Sugimoto et al. ..... 273/227 |
| 5,480,143 | A | | 1/1996 | McMurry |
| 5,688,191 | A | | 11/1997 | Cavallaro et al. ..... 473/373 |
| 5,759,676 | A | | 6/1998 | Cavallaro et al. ..... 428/215 |
| 5,779,561 | A | | 7/1998 | Sullivan et al. ..... 473/373 |
| 5,779,562 | A | | 7/1998 | Melvin et al. ..... 473/373 |
| 5,810,678 | A | | 9/1998 | Cavallaro et al. ..... 473/373 |
| 5,813,923 | A | | 9/1998 | Cavallaro et al. ..... 473/373 |
| 5,820,485 | A | | 10/1998 | Hwang |
| 5,830,086 | A | | 11/1998 | Hayashi et al. ..... 473/376 |
| 5,836,834 | A | * | 11/1998 | Masutani et al. ..... 473/374 |
| 5,984,807 | A | | 11/1999 | Wai et al. |
| 6,066,054 | A | * | 5/2000 | Masutani ..... 473/374 |

* cited by examiner

GOLF BALL

FIELD OF THE INVENTION

This invention generally relates to golf balls, and more particularly, to a golf ball with an improved core.

BACKGROUND OF THE INVENTION

Conventional golf balls have been designed to provide particular playing characteristics. These characteristics are generally initial velocity, compression, and spin of the golf ball, which can be optimized for various types of players. For instance, certain players prefer a ball that has a high spin rate in order to control the ball flight and stop the golf ball on impact with the greens. This type of ball, however, does not provide maximum distance. Other players prefer a ball that has a low spin rate and high resiliency to maximize distance.

Generally, golf balls have been classified as wound balls or solid balls. Wound balls are generally constructed from a liquid or solid center surrounded by an elastic thread wound in tension to form a wound core. This wound core is then surrounded by a cover. Wound balls are generally thought of as performance golf balls, not distance balls. When struck by a golf club, these balls have good resiliency, relatively high spin rate, and "soft" feel. Wound balls are generally more difficult to manufacture than solid golf balls.

Early solid golf balls were generally comprised of a hard core and a hard cover. However, if the golf ball has a soft core and a hard cover, it has a low spin rate. If the golf ball has a hard core and a hard cover, it exhibits very high resiliency for distance, but a "hard" feel and is difficult to control on the greens. Additionally, if the golf ball has a hard core and a soft cover, it will have a high rate of spin. More recently developed solid balls are comprised of a core, at least one intermediate layer, and a cover. The intermediate layers improve the playing characteristics of solid balls, and can be composed of thermoset or thermoplastic materials.

Typically, solid golf ball cores are spherical and solid. In an effort to improve the playing characteristics of balls, typically the golf ball core diameter or core compression has been varied. It is desired to provide a solid golf ball with an improved core that provides unique performance characteristics.

DESCRIPTION OF THE PRIOR ART

Several patents have been issued which are directed towards modifying the geometry of various golf balls and components thereof.

Several patents are directed to spherical cores that have been modified with features such as bores or projections. U.S. Pat. No. 2,364,955 issued to Diddel, for example, discloses a golf ball that has a spherical core with radially extending bores. The bores are filled with a frangible material. Then the core is encased in a cover. On impact the frangible material breaks in order to absorb the impact energy. By absorbing this energy, the invention is supposed to decrease the rebound or resilience of the ball and provide a short distance ball. As a result, it is stated smaller golf courses may be used.

U.S. Pat. No. 720,852 issued to Smith discloses an internal core with a spherical surface that includes small, solid protuberances projecting therefrom. The core is encased in a rubber layer having small, solid protuberances projecting therefrom. A silk layer is wound thereon, then the ball is encased in an outer covering. The purpose of the core protuberances is to allow good anchorage for the rubber and silk layers and to increase the resiliency of the ball as a whole.

In other instances hollow, spherical cores are used. For example, U.S. Pat. No. 1,524,171 issued to Chatfield discloses a core with a hollow, spherical center that supports cylindrical, solid lugs. A spherical casing surrounds and abuts the tips of the lugs. The lugs and casing are designed so that the casing compresses the lugs in the finished ball. Fluid or wound rubber bands occupy the space around the lugs, between the spherical center and the casing. The lugs are meant to promote accurate location of the center by facilitating uniform and spherical winding of the rubber bands about the center. An outer shell surrounds the casing.

U.K. Pat. Application No. 2,162,072 issued to Slater discloses a golf ball with an inner core that includes a plurality of solid, support members or struts that diverge from a common center. The struts form a generally cubic, tetrahedral, or octahedral shaped core. The struts serve to locate the inner core symmetrically within a mold cavity. An outer core is molded about the inner core, and a cover is molded thereon.

U.S. Pat. No. 5,480,143 issued to McMurry discloses a substantially spherical practice ball comprising mutually perpendicular members with a plurality of walls that interconnect the members. The walls are for increasing the drag on the ball so that smaller playing fields can be used.

U.S. Pat. No. 5,836,834 issued to Masutani et al. discloses a two or three piece golf ball comprising a two-layer solid core composed of a low-hardness inner core and a high-hardness outer core joined around the low-hardness inner core. A projection is formed on the inner surface of the high-hardness outer core such that the projection extends along an approximate normal direction, while a depression corresponding to the projection is formed in the outer surface of the low-hardness inner core, and the low-hardness inner core and the high-hardness outer core are joined together such that the projection is inserted into the depression.

However, these patents do not disclose a golf ball having the configuration as disclosed herein to provide the improved golf balls of the present invention.

SUMMARY OF THE INVENTION

The present invention is directed to a golf ball having a core geometry designed to provide improved playing characteristics such as spin rate, initial velocity, compression, and feel.

The golf ball comprises an inner core, an outer core surrounding the inner core, and a cover encasing the cores. The inner core is one piece with a plurality of projections extending from a center portion. The solid or non-wound outer core is disposed around the projections so that the outer surface of the outer core is spherical to form a non-wound core. The inner core is formed of a first material and the outer core is formed of a second material. These materials have substantially different Shore D hardnesses, elastic modulii, specific gravities, or Bayshore resiliences. The cover may include one or more layers.

In one embodiment, the inner core includes a central portion and a plurality of spaced projections extending radially therefrom such that they form substantially a spheroid. In one embodiment, the projections are conical, and the projections include a base adjacent the outer surface of the central portion. The base is greater than or equal to the height of each projection.

In yet another embodiment, the inner core includes a central portion and a plurality of projections that have enlarged free ends which can define recesses for receiving material.

In another embodiment, the inner core is shaped like a spheroid and thus includes a substantially spherical outer surface including a plurality of projections and adjacent indentations. The projections have a maximum length greater than a maximum width. The outer core is disposed within the indentations and surrounding the inner core.

In another embodiment, the golf ball includes an inner core radius that includes only inner core material and an outer core radius that includes both inner and outer core material. The inner core and outer core volumes are calculated using the respective radius, and a transition volume is the difference between the two volumes. The golf ball in one embodiment is formed with a transition volume of at least about 10% of the outer core volume.

In one embodiment of the golf ball of the present invention, the elastic properties of the ball are such that the inner core and outer core materials are selected to satisfy the relationship below. When a first sample is formed of inner core material, a load can be applied to the sample and under the load the sample deflects so that a first ratio of the load over the sample deflection is measured. When a second sample is formed of the outer core material, a load can be applied to the sample and under the load the sample deflects so that a second ratio of the load over the sample deflection is measured. The inner and outer core materials should be selected so that the difference between the first and second ratios are at least about 10%.

The relationship between the outer core and the inner core are such that the ball has various playing characteristics at various club impact speeds.

DETAILED DESCRIPTION OF THE PREFERRED EMBODIMENTS

Figure 1:
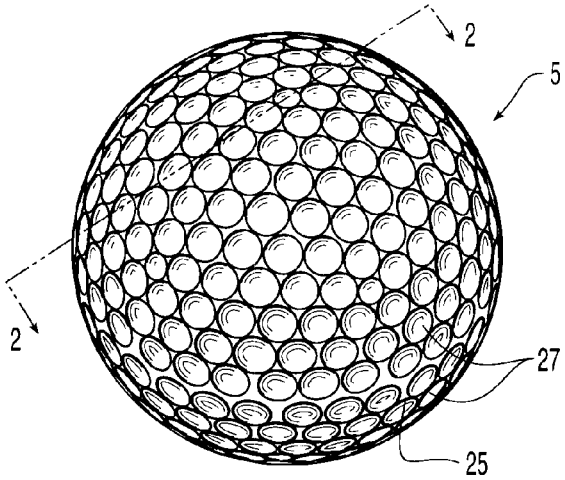
FIG. 1 is a side view of a golf ball according to the present invention.

Referring to FIG. 1, a golf ball 5 of the present invention is substantially spherical and has a cover 25 with a plurality of dimples 27 formed on the outer surface thereof.

Figure 2:
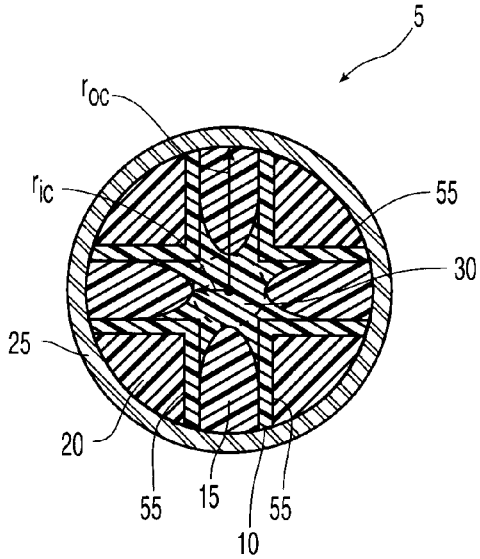
FIG. 2 is a cross-sectional view along the line 2—2 of FIG. 1 of the golf ball according to the present invention.
Figure 3:
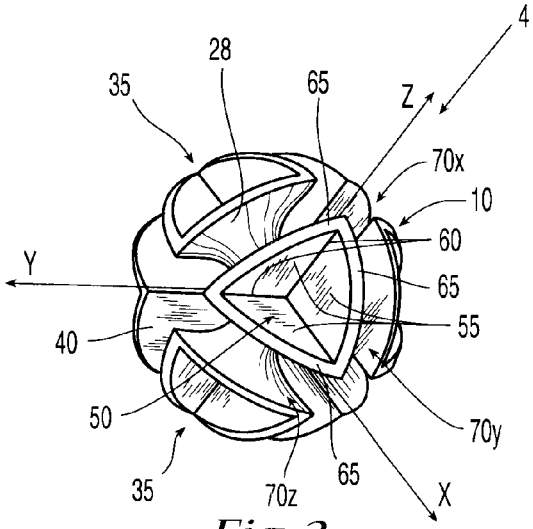
FIG. 3 is a side view of an inner core of the golf ball shown in FIG. 2.
Figure 4:
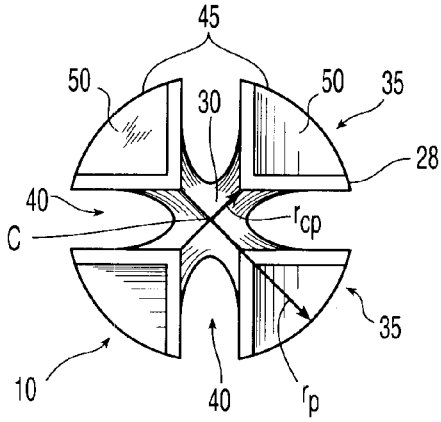
FIG. 4 is a plan view along the arrow 4 of FIG. 3 of the inner core according to the present invention.

Referring to FIGS. 2–4, the golf ball 5 includes an inner core 10, an outer core 15 and 20, and the cover 25 (shown without dimples). The inner core 10 includes a three-dimensional outer surface 28, a center C, a central portion 30, and a plurality of projections 35. The central portion 30 and projections 35 are integrally formed, so that the inner core is a single piece.

Referring to FIG. 4, the outer surface 28 of the inner core is defined by radial distances from the center C. At least two of the radial distances about the outer surface are different. The central portion 30 has a radius, designated by the arrow $r_{cp}$, that extends from the core center C to the outer surface of the central portion. The central portion 30 is solid in this embodiment.

Referring to FIGS. 3 and 4, each of the projections 35 extend radially outwardly from the central portion 30, and are spaced from one another to define gaps 40 there between. The projections 35 are shaped so that the inner core 10 is substantially spherically symmetrical.

Each projection 35 has an enlarged free end 45 and a substantially conical shape. Each free end 45 includes an open recess 50. Each projection has a radius, designated by the arrow $r_p$, that extends from the core center C to the outer surface 28 at the free end 45. The projection radii $r_p$ differ from the central portion radius $r_p$.

Referring to FIG. 3, each recess 50 is formed by three integral side walls 55. Each of the side walls 55 is shaped like a flat quarter circle. The quarter circle includes two straight edges 60 joined by a curved edge 65. In each projection 35, each of the side walls 55 is joined at the straight edges 60. The curved edges 65 of each of the projections allow the inner core to have a spherical shape.

With reference to a three-dimensional Cartesian Coordinate system, there are perpendicular x, y, and z axii, respectively that form eight octants. There are eight projections 35 with one in each octant of the coordinate system, so that each of the projections 35 forms an octant of the skeletal sphere. Thus, the inner core is symmetrical. The gaps 40 define three perpendicular concentric rings $\mathbf{70}_x$, $\mathbf{70}_y$, and $\mathbf{70}_z$. The subscript for the reference number 70 designates the central axis of the ring about which the ring circumscribes.

Turning to FIGS. 2 and 4, the outer core includes a first section 15 and a second section 20. The first section 15 fills the gaps 40 around the projections 35, and is disposed between the side walls 55 of adjacent projections 35. It is preferred that the diameter of the core which includes the inner core and the outer core is between about 1.00 inches and about 1.64 inches for a ball having a diameter of 1.68 inches.

The second section 20 fills the recesses 50 of each projection 35, and is disposed between the side walls 55 of a single projection 35. The outer core is formed so that the outer core terminates flush with the free end 45 of each projection 35. The outer core has a substantially spherical outer surface. The cover 25 is formed about the inner core 10 and the outer core sections 15 and 20, so that both the inner and outer cores abut the cover.

Referring to FIG. 2, the formation of a golf ball starts with forming the inner core 10. The inner core 10, outer core sections 15 and 20, and the cover 25 are formed by compression molding, by injection molding, or by casting. These methods of forming cores and covers of this type are well known in the art.

The materials used for the inner and outer core, as well as the cover, are selected so that the desired playing characteristics of the ball are achieved. The inner and outer core materials have substantially different material properties so that there is a predetermined relationship between the inner and outer core materials, to achieve the desired playing characteristics of the ball. The inner core is formed of a first material having a first Shore D hardness, a first elastic modulus, a first specific gravity, and a first Bayshore resilience. The outer core is formed of a second material having a second Shore D hardness, a second elastic modulus, a second specific gravity, and a second Bayshore resilience. Preferably, the first and second materials are selected so that at least one material property is in the group consisting of the first Shore D hardness differing from the second Shore D hardness by at least 10 points, the first elastic modulus differing from the second elastic modulus by at least 10%, the first specific gravity differing from the second specific gravity by at least 0.1, or a first Bayshore resilience differing from the second Bayshore resilience by at least 10%.

Moreover, it is preferred that the first material has the first Shore D hardness between about 30 and about 80, the first elastic modulus between about 5,000 psi and about 100,000 psi, the first specific gravity between about 0.8 and about 1.6, and the first Bayshore resilience greater than 30%.

In one embodiment, the first Shore D hardness is less than the second Shore D hardness, the first elastic modulus is less than the second elastic modulus, the first specific gravity is less than the second specific gravity, and the first Bayshore resilience is less than the second Bayshore resilience. In another embodiment, the first material properties are greater than the second material properties. The relationship between the first and second material properties depends on the desired playability characteristics.

Suitable inner and outer core materials include thermosets, such as rubber, polybutadiene, polyisoprene; thermoplastics such as ionomer resins, polyamides or polyesters; or a thermoplastic elastomer. Suitable thermoplastic-elastomers-include Pebax®, Hytrele®, thermoplastic urethane, and Kraton®, which are commercially available from Elf-Atochem, DuPont, various manufacturers, and Shell, respectively. The inner and outer core materials can also be formed from a castable material. Suitable castable materials include urethane, polyurea, epoxy, and silicone.

The cover 25 should be tough, cut-resistant, and selected from conventional materials used as golf ball covers based on the desired performance characteristics. The cover may be comprised of one or more layers. Cover materials such as ionomer resins, blends of ionomer resins, thermoplastic or thermoset urethane, and balata, can be used as known in the art.

Figure 5:
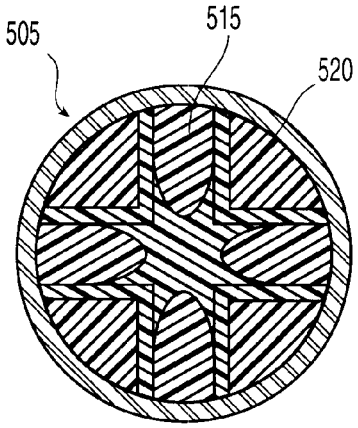
FIGS. 5–10 are cross-sectional views of other embodiments of golf balls according to the present invention.

Referring to FIG. 5, another embodiment of the golf ball 505 is shown. Similar structures to those discussed above use the same reference number preceded with the numeral "5." The golf ball 505 includes an outer core with a first section 515 and a second section 520. The first section 515 and the second section 520 are formed of two materials with different material properties. In this embodiment, the core includes three different materials.

Figure 6:
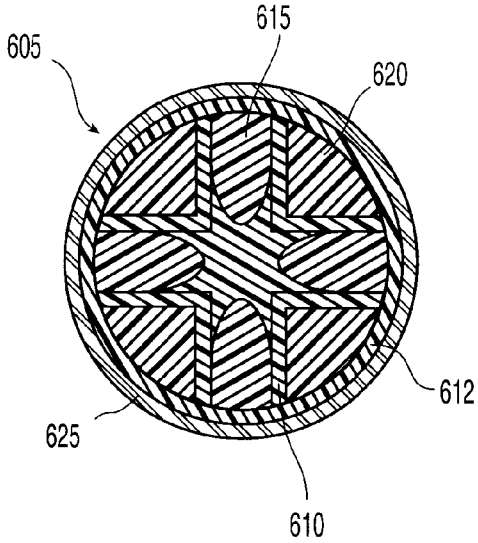

Referring to FIG. 6, another embodiment of the golf ball 605 is shown. Similar structures to those discussed above use the same reference number preceded with the numeral "6." The golf ball 605 includes an intermediate layer 612 disposed between the cover 625 and the inner core 610 and outer cores 615 and 620. The intermediate layer 612 is formed of either inner core material, outer core material, cover material, or a different thermoplastic or thermoset material used for intermediate layers of golf balls. The first section 615 and the second section 620 of the outer core are formed of materials with the same material properties. However, in another embodiment, sections 615 and 620 can be formed of different materials. The intermediate layer 612 covers the inner core 610, outer core 615 and 620, and forms a continuous layer beneath the cover 625.

Figure 7:
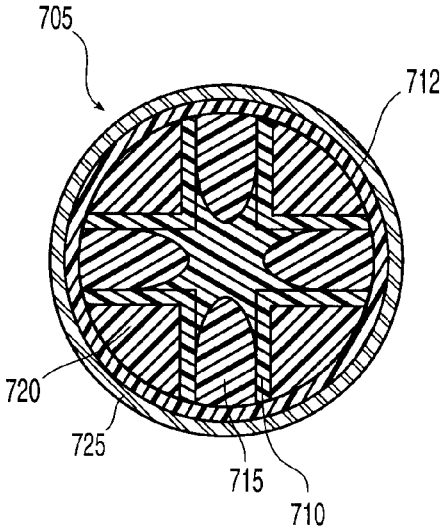

Referring to FIG. 7, another embodiment of the golf ball 705 is shown. Similar structures to those discussed above use the same reference number preceded with the numeral "7." The golf ball 705 includes an intermediate layer 712 disposed between the cover 725 and the inner core 710 and outer cores 715 and 720. The intermediate layer 712 is formed of either inner core material, outer core material, cover material or a different material used for intermediate layers of golf balls. The first section 715 and the second section 720 of the outer core are formed of materials with different thermoplastic or thermoset material properties. The intermediate layer 712 covers the inner core 710, outer core 715 and 720, and forms a continuous layer beneath the cover 725.

Figure 8:
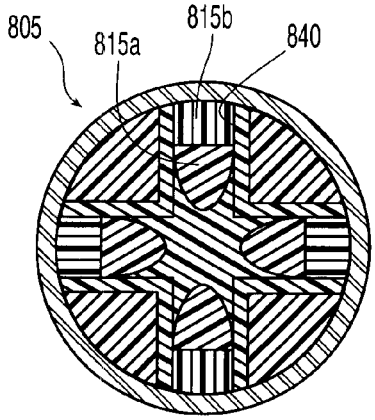

Referring to FIG. 8, another embodiment of the golf ball 805 is shown. Similar structures to those discussed above use the same reference number preceded with the numeral "8." The golf ball 805 includes an outer core with a multi-material first section 815*a* and 815*b* disposed within the gaps 840. The different portions 815*a*, 815*b* of the first section of the outer core are formed of two materials with different material properties.

In other embodiments, additional layers may be added to those mentioned above or the existing layers may be formed by multiple materials.

Figure 9:
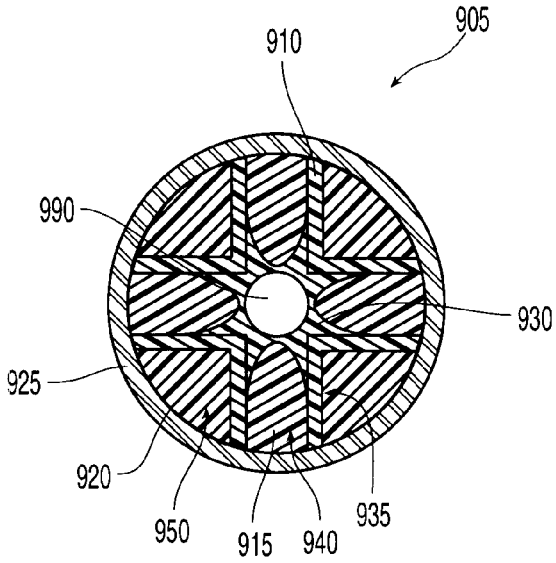

Referring to FIG. 9, another embodiment of the golf ball 905 is shown. Similar structures to those discussed above use the same reference number preceded with the numeral "9." The golf ball 905 includes an inner core 910 including a central portion 930 and a plurality of outwardly radially extending projections 935. The central portion 930 is hollow to define a chamber 990 therein. The outer core is formed from a first section 915 disposed within the gaps 940, and a second section 920 disposed within the recesses 950. The first section and the second section are formed of material with the same material properties. The cover section 925 surrounds the outer core 915 and 920. The hollow central portion 930 reduces the volume of the inner core 910 material. The central portion may include a fluid.

Figure 10:
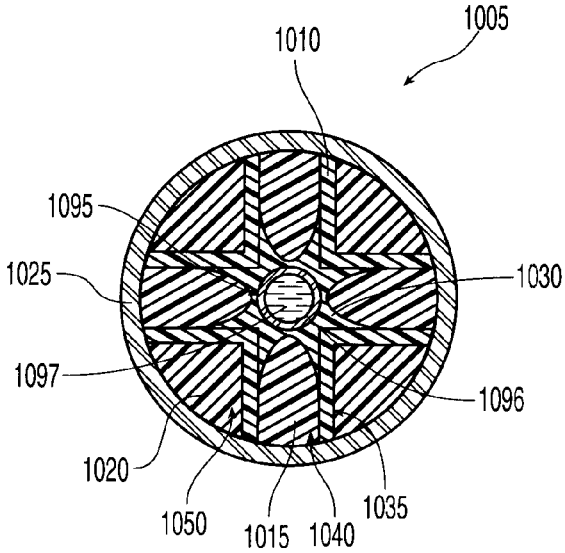

Referring to FIG. 10, another embodiment of the golf ball 1005 is shown. Similar structures to those discussed above use the same reference number preceded with the numeral "10." The golf ball 1005 includes an inner core 1010 and an outer core 1015, 1020. The inner core 1010 includes a central portion 1030 and a plurality of outwardly radially extending projections 1035. The central portion 1030 is hollow and surrounds a fluid-filled center 1095. The fluid-filled center 1095 is formed of an envelope 1096 containing a fluid 1097. The outer core is formed from a first section 1015 disposed within the gaps 1040, and a second section 1020 disposed within the recesses 1050. The first section and the second section are formed of material with the same material properties. The cover material 1025 surrounds the inner and outer cores.

Referring to FIG. 10, when the core is formed with a fluid-filled center 1095, the center is formed first then the inner core 1020 is molded around the center. Conventional molding techniques can be used for this operation. Then the outer core 1015, 1020 and cover 1025 are formed thereon, as discussed above.

Referring to FIGS. 9 and 10, the fluid within the inner core can be a wide variety of materials including air, water solutions, liquids, gels, foams, hot-melts, other fluid materials and combinations thereof. The fluid is varied to modify the performance parameters of the ball, such as the moment of inertia or the spin decay rate.

Examples of suitable liquids include either solutions such as salt in water, corn syrup, salt in water and corn syrup, glycol and water or oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthenic oil. Examples of suitable melts include waxes and hot melts. Hot-melts are materials which at or about normal room temperatures are solid but at elevated temperatures become liquid. A high melting temperature is desirable since the liquid core is heated to high temperatures during the molding of the inner core, outer core, and the cover. The liquid can be a reactive liquid system, which combines to form a solid. Examples of suitable reactive liquids are silicate gels, agar gels, peroxide cured polyester resins, two part epoxy resin systems and peroxide cured liquid polybutadiene rubber compositions.

Figure 11:
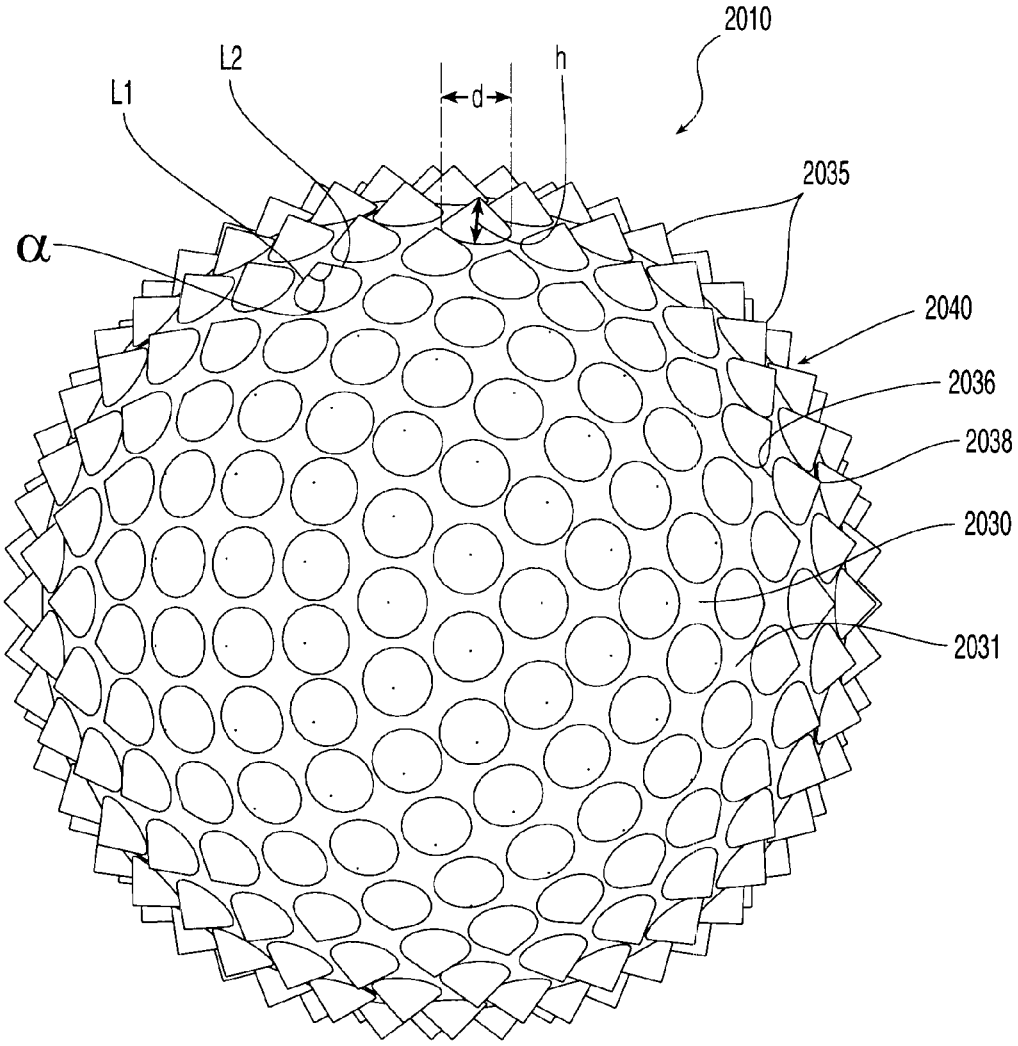
FIG. 11 is a perspective view of another embodiment of the inner core according to the present invention.

Referring to FIG. 11, another embodiment of an inner core 2010 is shown. The inner core 2010 includes a spherical central portion 2030 having an outer surface 2031, and a plurality of projections 2035 extending radially outwardly from the central portion 2030. The projections 2035 include a base 2036 adjacent the outer surface 2031 and a pointed free end 2038. The projections 2035 are substantially conical and taper from the base 2036 to the pointed free end 2038. It is preferred that the bases cover greater than about 15% of the outer surface. More preferably, the bases should cover greater than about 50% of the outer surface. Most preferably, the bases should be circular in shape and cover greater than about 80% of the outer surface and less than about 85%. As a result, the projections 2035 are spaced from one another and the area of the outer surface 2031 between each projection base 2036 is less than the area of each base. The projections 2035 are conical and configured so that the free ends 2038 of the projections form a spheroid. The base can have other shapes, such as polygons. Examples of polygon shapes that can be used for the base are triangles, pentagons, and hexagons. In addition, instead of the projections having a circular cross-section they can have other cross-sectional shapes such as square.

The projections further include a base diameter, designated by the letter d, and a projection height, designated by the letter h. It is preferred that the base-diameter d is greater than or equal to the projection height h. This allows an included angle a between two diametrically opposed sides of the projection, designated L1 and L2, to be about 60° or more. More preferably the angle $\alpha$ is about 90° or more and most preferably the angle a is about 135°. This allows a simple mold to be used from which the core can be extracted.

To form a golf ball with inner core 2010 an outer core, as discussed above, is disposed around the inner core 2010 so that the outer core material is disposed within the gaps 2040 and the outer surface of the outer core is substantially spherical. The materials for the inner and outer cores are as discussed above. Then, the cover is formed thereon. The outer surface of the inner core has non-uniform radial distances from the center to various locations on the outer surface due to the conical projections 2035.

Figure 12:
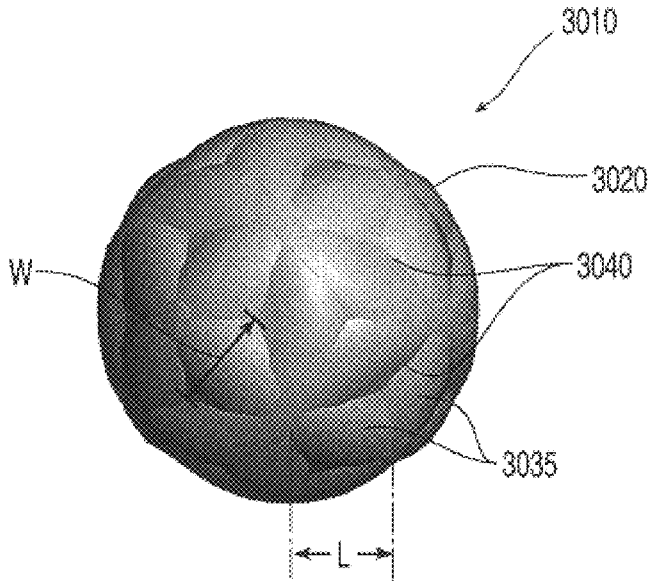
FIG. 12 is a side view of another embodiment of the inner core according to the present invention.

Referring to FIG. 12, another embodiment of an inner core 3010 is shown. The inner core outer surface 3020 includes a plurality of projections 3035 formed so that gaps 3040 are formed surrounding each projection and between projections. Each projection includes a maximum length, which is the longest length of the projection, designated L. Each projection also includes a maximum width, which is the widest width of the projection, designated W. The surface of the projection is curved along the length L and width W. A substantial number of projections have the maximum length greater than the maximum width so that the projections are elongated. To form a golf ball, an outer core, as discussed above, is disposed around the inner core 3010 so that the outer core material is disposed within the gaps. The outer core material forms a substantially spherical surface. The materials for the inner and outer cores are as discussed above. Then a cover is formed thereon. The outer surface of the inner core has non-uniform radial distances from the center due to the projections and the indentations.

In this embodiment, in order to form the outer surface of this inner core, first, second and third surfaces are formed by rotation of a wave form about first, second and third axii, respectively. These axii are the x-, y- and z-axii in a Cartesian Coordinate System. The wave form used is sine wave. However, other wave forms can be used including, but not limited to, cosine or saw-tooth wave forms.

Figure 13:
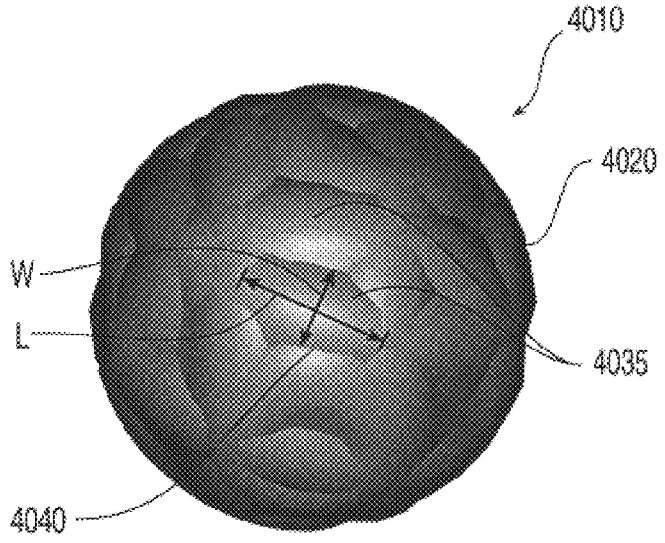
FIG. 13 is a side view of another embodiment of the inner core according to the present invention.

Referring to FIG. 13, an inner core 4010, similar to that shown in FIG. 12, is illustrated. The inner core outer surface 4020 includes a plurality of projections 4035 formed so that gaps 4040 are formed surrounding each projection and between projections. Each projection includes a maximum length, which is the longest length of the projection, designated L. Each projection also includes a maximum width, which is the widest width of the projection, designated W. The surface of the projection is curved along the length L and width W. A substantial number of projections have the maximum length greater than the maximum width so that the projections are elongated.

In this embodiment, in order to form the outer surface of this inner core, the first, second, and third surfaces are formed as discussed above, and a fourth surface that is formed by rotating the wave form about a fourth axis that is about 45° from the first and second axii. The surface of the inner core 4020 is formed by the intersection of the first, second, third and fourth surfaces. Any number of surfaces greater than three can be used to create different outer surface geometries for the inner core. Furthermore, different axii can also be used.

In all the embodiments except those shown in FIGS. 9 and 10, there is a characteristic of the core that is called "transition volume," which will now be discussed. Referring to FIG. 2, the ball 5 has an inner core radius $r_{ic}$ that includes only inner core material. The ball further includes an outer core with an outer core radius $r_{oc}$ that includes both the inner core material and the outer core material. The inner core volume is calculated using the inner core radius and the outer core or total core volume is calculated using the outer core radius. The transition volume is the outer core volume less the inner core volume. Favorable cores have been formed when the transition volume is at least 10% of the total core volume.

In addition, with respect to all of the embodiments except those shown in FIGS. 9 and 10, the elastic properties referred to above with respect to the inner and outer core materials are defined by a ratio of deflection of a 1.50 inch diameter sphere made of any single material used in the core under a 100 kg load that is applied at a rate of approximately 25.4 mm/minute. The ratio is represented by the formula below:

$$\frac{F}{d}$$

where, F=100 kg load; and d=deflection in millimeters.

The sphere tested is only inner core material or only outer core material. The ratio for each such sphere should be selected so that the sphere ratios exhibit a substantial difference from one another. For example, it is preferred that the difference is at least about 10%, or more preferably that the difference is about 15%, and most preferably about 20%.

While it is apparent that the illustrative embodiments of the invention disclosed herein fulfill the objectives stated above, it is appreciated that numerous modifications and other embodiments may be devised by those skilled in the art. One such modification is that the outer surface can be flush with the inner surface free ends or it can extend beyond the free ends. Therefore, it will be understood that the appended claims are intended to cover all such modifications and embodiments which would come within the spirit and scope of the present invention.

I claim:

1. A golf ball comprising:

a) an inner core of a first material and including:
   i) a central portion; and
   ii) a plurality of spaced projections extending radially outward from the central portion forming gaps between each projection, and each projection having an enlarged free end, and the free ends further define recesses;

b) an outer core formed of a second material, said second material being disposed within the gaps and the recesses to form a core; and c) a cover surrounding the inner core and the outer core.

2. The golf ball of claim 1, wherein the second material disposed within the gaps and the second material disposed within the recesses have different material properties.

3. The golf ball of claim 1, further including an intermediate layer disposed between the outer and inner cores and the cover.

4. The golf ball of claim 1, wherein the first material disposed within the gaps includes two types of materials with different material properties.

5. The golf ball of claim 1, wherein the central portion is hollow.

6. The golf ball of claim 5, wherein the hollow central portion further includes a fluid therein.

7. The golf ball of claim 6, wherein the fluid is disposed within an envelope.

8. The golf ball of claim 1, further including the first material having a first Shore D hardness, a first elastic modulus, a first specific gravity, and a first Bayshore resilience, and the second material having a second Shore D hardness, a second elastic modulus, a second specific gravity, and a second Bayshore resilience, wherein the first and second materials are selected so that at least one material property is in the group consisting of the first Shore D hardness differing from the second Shore D hardness by at least 10 points, the first elastic modulus differing from the second elastic modulus by at least 10%, the first specific gravity differing from the second specific gravity by at least 0.1, or the first Bayshore resilience that differing from the second Bayshore resilience by at least 10%.

9. A golf ball comprising:

a) an inner core of a first material and including:
   i) a central portion having an outer surface; and
   ii) a plurality of projections extending radially outward from the central portion, said projections having a base-adjacent the outer surface, a free end, and each projection tapers from the base toward the free end, and each base being circular, and each base having a diameter greater than the height of the projection;

b) a non-wound outer core formed of a second material and being disposed around the inner core so that the outer surface of the outer core is substantially spherical; and c) a cover surrounding the inner core and the outer core.

10. The golf ball of claim 9, wherein the bases cover greater than about 15% of the outer surface of the central portion.

11. The golf ball of claim 9, wherein the bases cover greater than about 50% of the outer surface of the central portion.

12. The golf ball of claim 9, wherein the bases cover greater than about 80% of the outer surface of the central portion.

13. The golf ball of claim 9, wherein the projections are substantially conical in shape.

14. The golf ball of claim 9, further including the first material having a first Shore D hardness, a first elastic modulus, a first specific gravity, and a first Bayshore resilience, and the second material having a second Shore D hardness, a second elastic modulus, a second specific gravity, and a second Bayshore resilience, wherein the first and second materials are selected so that at least one material property is in the group consisting of the first Shore D hardness differing from the second Shore D hardness by at least 10 points, the first elastic modulus differing from the second elastic modulus by at least 10%, the first specific gravity differing from the second specific gravity by at least 0.1, or the first Bayshore resilience that differing from the second Bayshore resilience by at least 10%.

15. A golf ball comprising:

a) an inner core formed of a first material and including a substantially spherical outer surface that includes a plurality of projections formed so that gaps are formed surrounding each projection, and each projection having a base adjacent the outer surface and a spaced free end, and each projection has a maximum length greater than a maximum width and a width of the free end is greater than a width of the base;

b) an outer core formed of a second material and being disposed around the inner core; and c) a cover surrounding the outer core.

16. The golf ball of claim 15, wherein the surface of each projection is curved along the maximum width and the maximum length.

17. The golf ball of claim 15, wherein the surface of the inner core is described by the intersection of a first surface, a second surface, and a third surface, the first surface being formed by a wave form extending about a first axis, the second surface being formed by the wave form extending about a second axis, and the third surface being formed by the wave form extending about a third axis.

18. The golf ball of claim 17, wherein the first axis is the x-axis of a Cartesian Coordinate System, the second axis is the y-axis of a Cartesian Coordinate System, and the third axis is the z-axis of a Cartesian Coordinate System.

19. The golf ball of claim 18, wherein the wave form is a sine wave.

20. The golf ball of claim 17, wherein the surface of the inner core is described by the intersection of the first surface, the second surface, the third surface, and a fourth surface, the fourth surface being formed by the wave form extending about a fourth axis that is about 45° between the first and second axii.

21. The golf ball of claim 15, further including the first material having a first Shore D hardness, a first elastic modulus, a first specific gravity, and a first Bayshore resilience, and the second material having a second Shore D hardness, a second elastic modulus, a second specific gravity, and a second Bayshore resilience, wherein the first and second materials are selected so that at least one material property is in the group consisting of the first Shore D hardness differing from the second Shore D hardness by at least 10 points, the first elastic modulus differing from the second elastic modulus by at least 10%, the first specific gravity differing from the second specific gravity by at least 0.1, and the first Bayshore resilience that differing from the second Bayshore resilience by at least 10%.

22. The golf ball of claim 21, wherein the first Shore D hardness is less than a second Shore D hardness, the first elastic modulus is less than the second elastic modulus, the first specific gravity is less than the second specific gravity, and the first Bayshore resilience is less than the second Bayshore resilience.

23. The golf ball of claim 21, wherein a first Shore D hardness is greater than a second Shore D hardness, the first elastic modulus is greater than the second elastic modulus, the first specific gravity is greater than the second specific gravity, and the first Bayshore resilience is greater than the second Bayshore resilience.

24. The golf ball of claim 21, wherein the first Shore D hardness is between about 30 to about 80, the first elastic modulus is between about 5,000 psi to about 100,000 psi, the first specific gravity is between about 0.8 to about 1.6, and the first Bayshore resilience is greater than 30%.

25. The golf ball of claim 15, wherein the first material and the second material are rubber.

26. A golf ball comprising:

a) an inner core of a first material and including:

i) a central portion; and ii) a plurality of spaced projections extending radially outward from the central portion forming gaps between each projection, where the inner core includes an inner core volume that includes only the first material;

b) an outer core formed of a second material, said second material being disposed within the gaps and the outer core includes an outer core volume that includes the first and second materials, the outer core having an outer surface and the projections extend substantially to the outer surface, the inner core and the outer core defining a transition volume, the transition volume being the difference between the outer core volume and the inner core volume, the transition volume being at least 10% of the outer core volume; and c) a cover surrounding the inner core and the outer core;

wherein a first ratio of load over deflection for the first material differs from a second ratio of load over deflection for the second material by at least about 10%.

27. The golf ball of claim 26, wherein the difference between the first ratio and the second ratio is at least about 15%.

28. The golf ball of claim 26, wherein the difference between the first ratio and the second ratio is at least about 20%.

29. The golf ball claim 15, wherein the outer core is non-wound.

30. A golf ball comprising:

a) an inner core formed of a first material and including a substantially spherical outer surface that includes a plurality of projections formed so that gaps are formed surrounding each projection, and the projections having a maximum length greater than the maximum width;

b) an outer core formed of a second material and being disposed around the inner core; and c) a cover surrounding the outer core;

wherein the surface of each projection is curved along the maximum width and the maximum length.

31. A golf ball comprising:

a) an inner core formed of a first material and including a substantially spherical outer surface that includes a plurality of projections formed so that gaps are formed surrounding each projection, and the projections having a maximum length greater than the maximum width;

b) an outer core formed of a second material and being disposed around the inner core; and c) a cover surrounding the outer core;

wherein the surface of the inner core is described by the intersection of a first surface, a second surface, and a third surface, the first surface being formed by a wave form extending about a first axis, the second surface being formed by the wave form extending about a second axis, and the third surface being formed by the wave form extending about a third axis.

32. The golf ball of claim 31, wherein the first axis is the x-axis of a Cartesian Coordinate System, the second axis is the y-axis of a Cartesian Coordinate System, and the third axis is the z-axis of a Cartesian Coordinate System.

33. The golf ball of claim 32, wherein the wave form is a sine wave.

34. The golf ball of claim 31, wherein the surface of the inner core is described by the intersection of the first surface, the second surface, the third surface, and a fourth surface, the fourth surface being formed by the wave form extending about a fourth axis that is about 45° between the first and second axii.

35. A golf ball comprising:

a) an inner core formed of a first material and including a substantially spherical outer surface that includes a plurality of projections formed so that gaps are formed surrounding each projection, and the projections having a maximum length greater than the maximum width;

b) an outer core formed of a second material and being disposed around the inner core; and c) a cover surrounding the outer core;

wherein:

the first material has a first Shore D hardness, a first elastic modulus, a first specific gravity, and a first Bayshore resilience;

the second material has a second Shore D hardness, a second elastic modulus, a second specific gravity, and a second Bayshore resilience; and the first and second materials are selected so that at least one material property is in the group consisting of the first Shore D hardness differing from the second Shore D hardness by at least 10 points, the first elastic modulus differing from the second elastic modulus by at least 10%, the first specific gravity differing from the second specific gravity by at least 0.1, and the first Bayshore resilience that differing from the second Bayshore resilience by at least 10%.

36. The golf ball of claim 35, wherein the first Shore D hardness is less than a second Shore D hardness, the first elastic modulus is less than the second elastic modulus, the first specific gravity is less than the second specific gravity, and the first Bayshore resilience is less than the second Bayshore resilience.

37. The golf ball of claim 35, wherein a first Shore D hardness is greater than a second Shore D hardness, the first elastic modulus is greater than the second elastic modulus, the first specific gravity is greater than the second specific gravity, and the first Bayshore resilience is greater than the second Bayshore resilience.

38. The golf ball of claim 35, wherein the first Shore D hardness is between about 30 to about 80, the first elastic modulus is between about 5,000 psi to about 100,000 psi, the first specific gravity is between about 0.8 to about 1.6, and the first Bayshore resilience is greater than 30%.

* * * * *